US012408743B2

(12) United States Patent
Jenkins

(10) Patent No.: US 12,408,743 B2
(45) Date of Patent: Sep. 9, 2025

(54) HAIR CLIP DEVICES

(71) Applicant: Anthony George Jenkins, Pyrmont (AU)

(72) Inventor: Anthony George Jenkins, Pyrmont (AU)

( * ) Notice: Subject to any disclaimer, the term of this patent is extended or adjusted under 35 U.S.C. 154(b) by 343 days.

(21) Appl. No.: 17/932,089

(22) Filed: Sep. 14, 2022

(65) Prior Publication Data

US 2024/0081503 A1 Mar. 14, 2024

(51) Int. Cl.
*A45D 8/20* (2006.01)

(52) U.S. Cl.
CPC ..... *A45D 8/20* (2013.01)

(58) Field of Classification Search
CPC ..... A45D 8/20; A45D 8/24; A45D 8/30
See application file for complete search history.

(56) References Cited

U.S. PATENT DOCUMENTS

| | | | | |
|---|---|---|---|---|
| D814,112 | S * | 3/2018 | Hsu | D28/40 |
| D829,990 | S * | 10/2018 | Hsu | D28/40 |
| 2007/0131237 | A1* | 6/2007 | Tu | A45D 8/20 132/277 |
| 2012/0080048 | A1 | 4/2012 | Chen | |
| 2017/0181518 | A1* | 6/2017 | Hsu | B29C 45/2626 |
| 2023/0413971 | A1* | 12/2023 | Sze | A45D 8/20 |

FOREIGN PATENT DOCUMENTS

| | | | |
|---|---|---|---|
| DE | 202017102109 | * | 7/2017 |
| JP | S5669303 | U | 6/1981 |
| JP | H0436903 | U | 3/1992 |
| JP | 3047979 | U | 3/1997 |
| JP | 3218404 | U | 10/2018 |

* cited by examiner

*Primary Examiner* — Rachel R Steitz
(74) *Attorney, Agent, or Firm* — Melvin Li

(57) ABSTRACT

The present invention is concerned with a hair clip device. The device has a first arm defining an inwardly facing surface and provided with a plurality of claw members, a second arm defining an inwardly facing surface and provided with a plurality of claw members, wherein at default the claw members of the first arm and the second arm are arranged alternately and complementarily, a first handle member connected to the first arm, and a second handle member connected to the second arm. The first and second handle members are pivotably connected together and, cooperatively, are configured for controlling relative pivotable movement of the first and second arms. First and second spikes members extend from the inwardly facing surface of the first and second arms. The claw members, the first spike members and the second spike members are of different length.

19 Claims, 19 Drawing Sheets

Section A-A'

Section B-B'

Section C-C'

HAIR CLIP DEVICES

FIELD OF THE INVENTION

The present invention is concerned with hair clip devices, and in particular hair claw devices for use in managing hair style.

BACKGROUND OF THE INVENTION

There are a variety of hair accessories for use in managing hair. Different such accessories are often different in terms of their functionaries and effectiveness. Despite some hair accessories are lower cost items, yet many users of hair accessories have high expectations and are cost-sensitive, and as such hair accessories that do not provide sufficient comfort or reliability, or are made with complicated manufacture steps, would be commercially impractical. Further, different users are different in terms of hair volume, hair texture, hair management requirements, etc. As such, a hair accessory which can satisfactorily address hair securement needs of a user may not also not work similarly on another user.

One particular type of hair accessories is hair claw for securing hair in place. While there are a variety of hair claws in the market, at least some are unsatisfactory in that they do not provide sufficiently tight hair fastening capability.

The present invention seeks to address the above problems, or at least to provide alternatives to the public.

SUMMARY OF THE INVENTION

According to a first aspect of the present invention, there is provided a hair clip device comprising a first arm defining an inwardly facing surface and provided with a plurality of claw members, a second arm defining an inwardly facing surface and provided with a plurality of claw members, wherein at default the claw members of the first arm and the second arm are arranged alternately and complementarily, and a first handle member connected to the first arm, and a second handle member connected to the second arm, the first and second handle members pivotably connected together and cooperatively configured for controlling relative pivotable movement of the first and second arms, and first and second spikes members extending from the inwardly facing surface of the first and second arms, wherein the claw members of the first arm are substantially longer than the first and second spike members, and the first and second spike members are of different length. Specifically, the first and second spike members of the first arm are different in length, and the first and second spike members of the second arm are different in length.

Preferably, the first and second arms may be of a first material, and the first and second handle members are made of a second material stiffer than the first material, wherein the first material may be selected from the group consisting of polypropylene (PP), general purpose polystyrene polymer (GPPS), high impact polystyrene (HIPS), acrylic, polycarbonate (PC), acrylonitrile butadiene (ABS), nylon, polyoxymethylene (POM) and acetate, and the second material is selected from the group consisting of polypropylene (PP), general purpose polystyrene polymer (GPPS), high impact polystyrene (HIPS), acrylic, polycarbonate (PC), acrylonitrile butadiene (ABS), nylon, polyoxymethylene (POM) and acetate.

Suitably, the first arm, the claw members of the first arm and the first and second spike members of the first arm may be made of the first material, and the claw members of the second arm, the second arm and the first and second spike members of the second arm may also be made of the first material.

Advantageously, the device may comprise a first connector for securing the first arm to the first handle member, and a second connector for securing the second arm to the second handle member.

In an embodiment, the first spike members of the first arm may become progressively shorter towards a rear end of the first arm, the second spike members of the first arm become progressively shorter towards the rear end of the first arm, the first spike members of the second arm become progressively shorter towards a rear end of the second arm, and the second spike members of the second arm become progressively shorter towards the rear end of the second arm.

In one embodiment, the inwardly facing surface of the first arm may be non-planar, distal ends of the first spike members of the first arm extending from the inwardly facing surface of the first arm may define a plane where the first spike members thereof end, distal ends of the second spike members of the first arm extending from the inwardly facing surface of the first arm define a plane where the second spike members thereof end, the inwardly facing surface of the second arm may be non-planar, distal ends of the first spike members of the second arm extending from the inwardly facing surface of the second arm may define a plane where the first spike members thereof end, and distal ends of the second spike members of the second arm extending from the inwardly facing surface of the second arm may define a plane where the second spike members thereof end.

In a specific embodiment, the first spike members of the first arm and the first spike members of the second arm do not overlap with each other, and the second spike members of the first arm and the second spike members of the second arm do not overlap with each other.

In a preferred embodiment, the first spike members of the first arm may have a length less than half of the length of the first claw members, and the first spike members of the second arm may have a length less than the length of the first claw members, The first claw members and the first and second spike members of the first arm generally may extend in a first direction or the same direction, and the second claw members and the first and second spike members of the second arm generally may extend in a direction opposite to the first direction.

The first claw members, and the first and second spike members, of the first arm, may extend in different directions, the second claw members, and the first and second spike members, of the second arm, may extend in different directions, and the first and second spike members of the first and second arms are oriented towards the first and second handle members.

According to a second aspect of the present invention, there is provided a hair clip device comprising a first arm defining an inwardly facing surface and provided with a plurality of claw members, a second arm defining an inwardly facing surface and provided with a plurality of claw members, wherein at default the claw members of the first arm and the second arm are arranged alternately and complementarily, a first handle member connected to the first arm, and a second handle member connected to the second arm, the first and second handle members pivotably connected together and cooperatively configured for controlling relative pivotable movement of the first and second arms, and first and second spikes members extending from the inwardly facing surface of the first arm, and wherein the first and second arms are made of a first material, and the first and second handle members are made of a second material stiffer than the first material, wherein the first material is selected from the group consisting of polypropylene (PP), general purpose polystyrene polymer (GPPS), high impact polystyrene (HIPS), acrylic, polycarbonate (PC), acrylonitrile butadiene (ABS), nylon, polyoxymethylene (POM) and acetate, and the second material is selected from the group consisting of polypropylene (PP), general purpose polystyrene polymer (GPPS), high impact polystyrene (HIPS), acrylic, polycarbonate (PC), acrylonitrile butadiene (ABS), nylon, polyoxymethylene (POM) and acetate.

Preferably, the claw members of the first arm may be substantially longer than the first and second spike members, and the first and second spike members may be of different length.

Suitably, the first spike members of the first arm may become progressively shorter towards a rear end of the first arm, the second spike members of the first arm may become progressively shorter towards the rear end of the first arm, the first spike members of the second arm may become progressively shorter towards a rear end of the second arm, and the second spike members of the second arm may become progressively shorter towards the rear end of the second arm.

In an embodiment, first claw members, the first and second spike members of the first arm, may generally extend in a first direction or the same direction, and the second claw members, and the first and second spike members of the second arm, generally may extend in a direction opposite to the first direction.

In one embodiment, the first claw members, and the first and second spike members, of the first arm, may extend in different directions, the second claw members, and the first and second spike members, of the second arm, may extend in different directions, and the first and second spike members of the first and second arms may be oriented towards the first and second handle members.

According to a third aspect of the present invention, there is provided a hair clip device comprising a first arm defining an inwardly facing surface and provided with a plurality of claw members, a second arm defining an inwardly facing surface and provided with a plurality of claw members, wherein at default the claw members of the first arm and the second arm are arranged alternately and complementarily, and a first handle member connected to the first arm, and a second handle member connected to the second arm, the first and second handle members pivotably connected together and cooperatively configured for controlling relative pivotable movement of the first and second arms, first and second spikes members extending from the inwardly facing surface of the first arm, wherein the first spike members of the first arm become progressively shorter towards the rear end of the first arm, the second spike members of the first arm become progressively shorter towards a rear end of the first arm, the first spike members of the second arm are become progressively shorter towards a rear end of the second arm, and the second spike members of the second arm become progressively shorter towards the rear end of the second arm.

Preferably, the claw members of the first arm may be substantially longer than the first and second spike members, and the first and second spike members may be of different length.

Preferably, the inwardly facing surface of the first arm may be non-planar, distal ends of the first spike members of the first arm extending from the inwardly facing surface of the first arm may define a plane where the first spike members thereof end, distal ends of the second spike members of the first arm extending from the inwardly facing surface of the first arm may define a plane where the second spike members thereof end, the inwardly facing surface of the second arm may be non-planar, distal ends of the first spike members of the second arm extending from the inwardly facing surface of the second arm may define a plane where the first spike members thereof end, and distal ends of the second spike members of the second arm extending from the inwardly facing surface of the second arm may define a plane where the second spike members thereof end.

In an embodiment, at default the first spike members of the first arm and the first spike members of the second arm do not overlap with each other, and the second spike members of the first arm and the second spike members of the second arm do not overlap with each other.

In one embodiment, the first spike members may have a length less than half of the length of the first claw members.

BRIEF DESCRIPTION OF THE DRAWINGS

Some embodiments of the present invention will now be explained, with reference to the accompanied drawings, in which.

DETAILED DESCRIPTION OF PREFERRED EMBODIMENTS OF THE INVENTION

Figure 1:
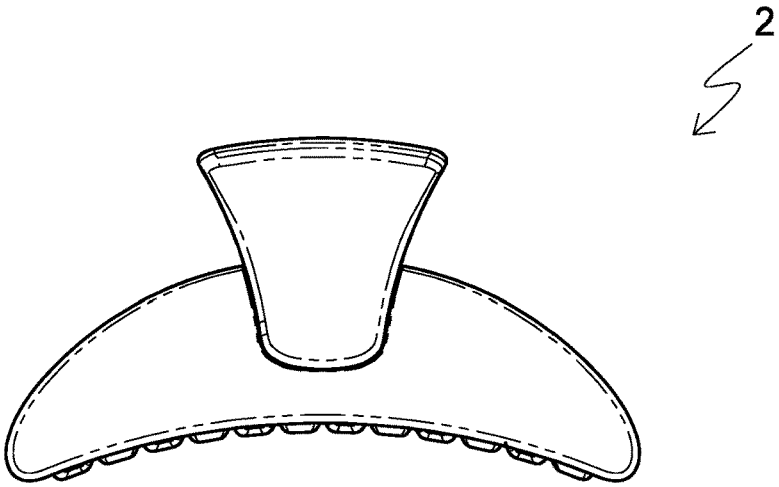
FIGS. 1 and 3 are top and bottom views of a first embodiment of a hair clip in accordance with the present invention, respectively.
Figure 2:
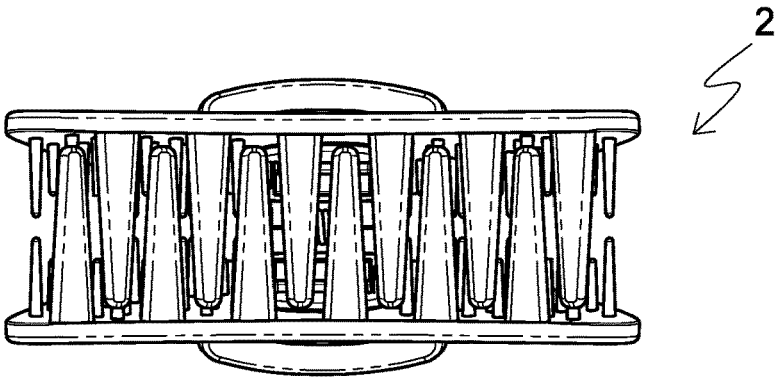
FIGS. 2 and 4 are front and rear views of the hair clip of FIG. 1, respectively.
Figure 3:
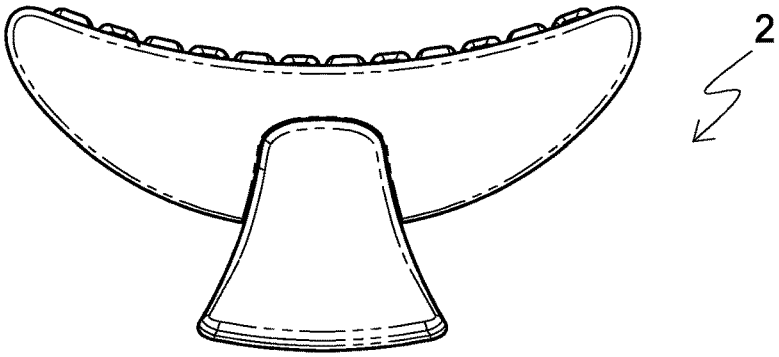
Figure 4:
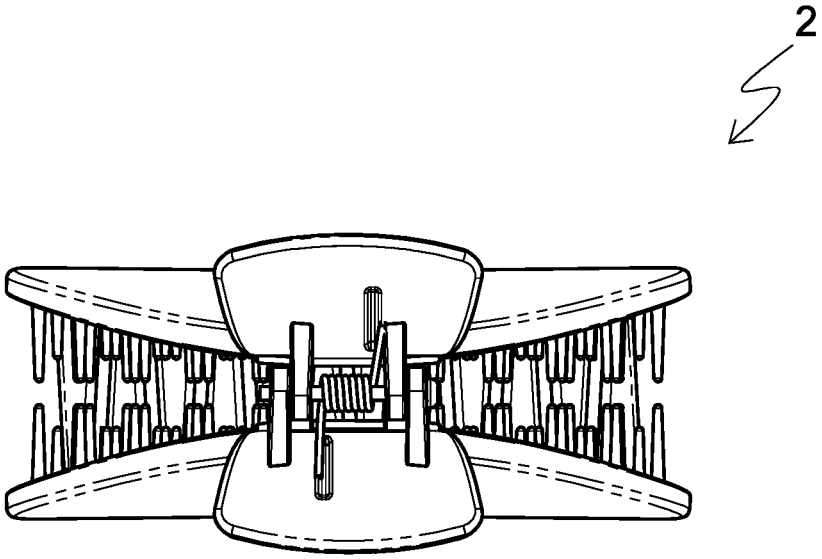
Figure 5:
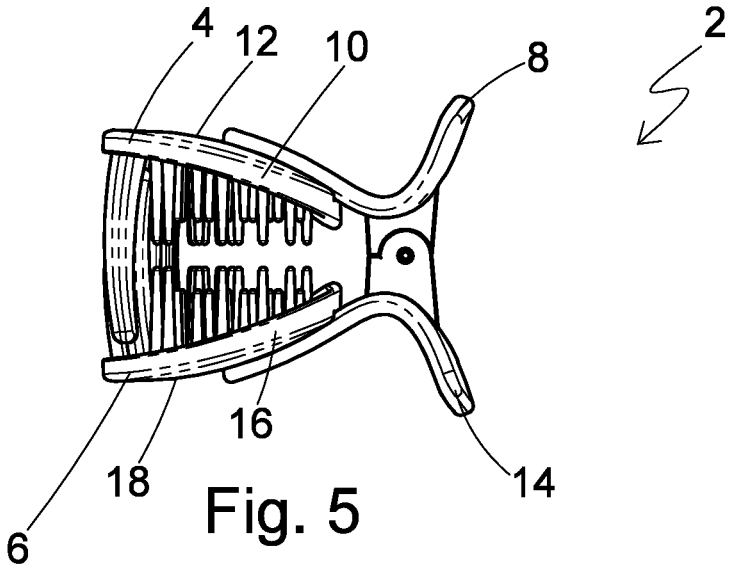
FIGS. 5 and 6 are opposite (lateral) side views of the hair clip of FIG. 1, respectively.
Figure 6:
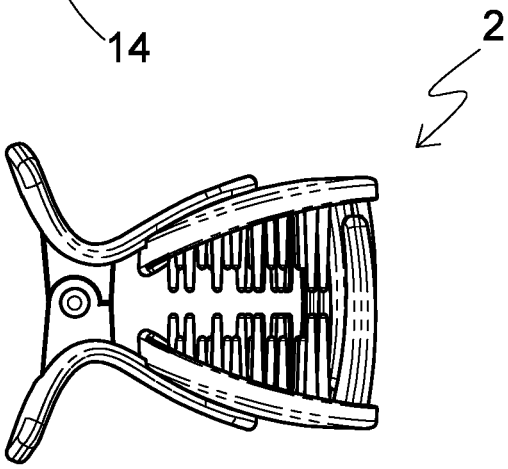

The present invention is concerned with a hair managing and styling accessory, and more particularly a hair clip in the form of a claw device for securing hair so as to maintain a hair style.

FIGS. 1 to 8 illustrate a first embodiment of a hair clip in the form of a hair claw generally designated 2 and comprises a first arm 4 and a second arm 6 pivotably connected to the first arm 4. In this embodiment, the clip 2 comprises a first handle member 8 connected to a rear end 10 of an outwardly facing surface 12 of the first arm 4, and a second handle member 14 connected to a rear end 16 of an outwardly facing surface 18 of the second arm 6. The first and second handle member 8, 14 are pivotably connected together. Please see in particular FIG. 5. In use, the first and second handle member 8, 14 cooperatively control relative pivotable movement of the first and second arms 4, 6.

Figure 7:
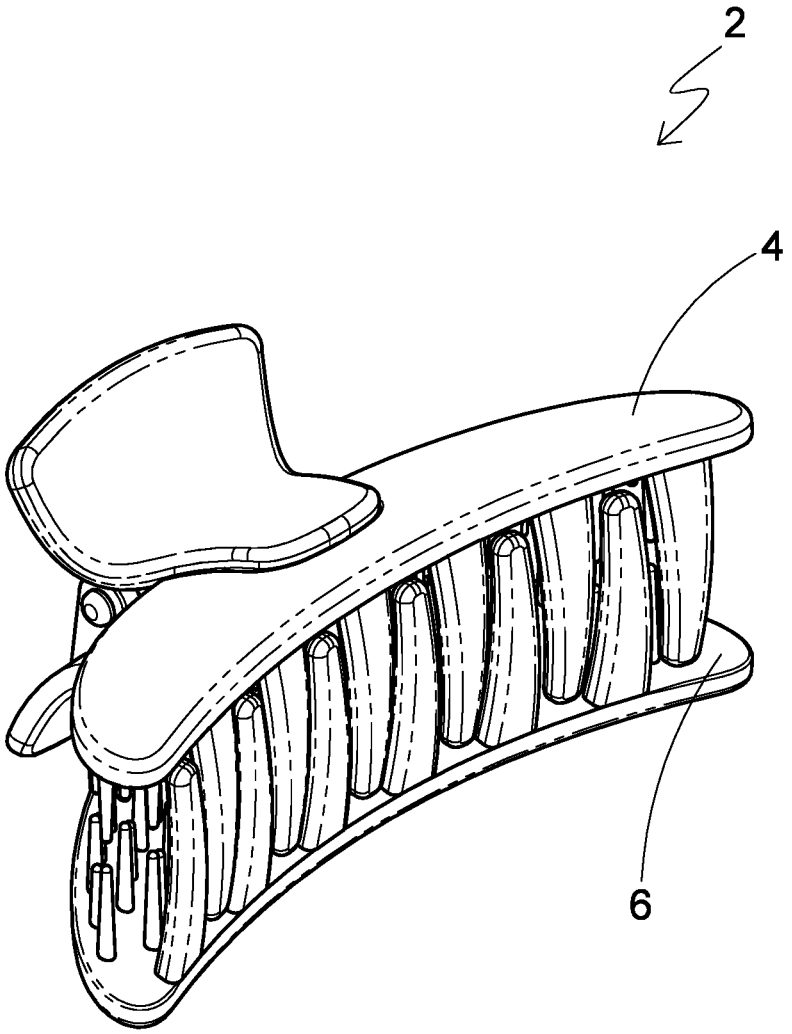
FIG. 7 is a perspective view of the hair clip of FIG. 1.
Figure 8:
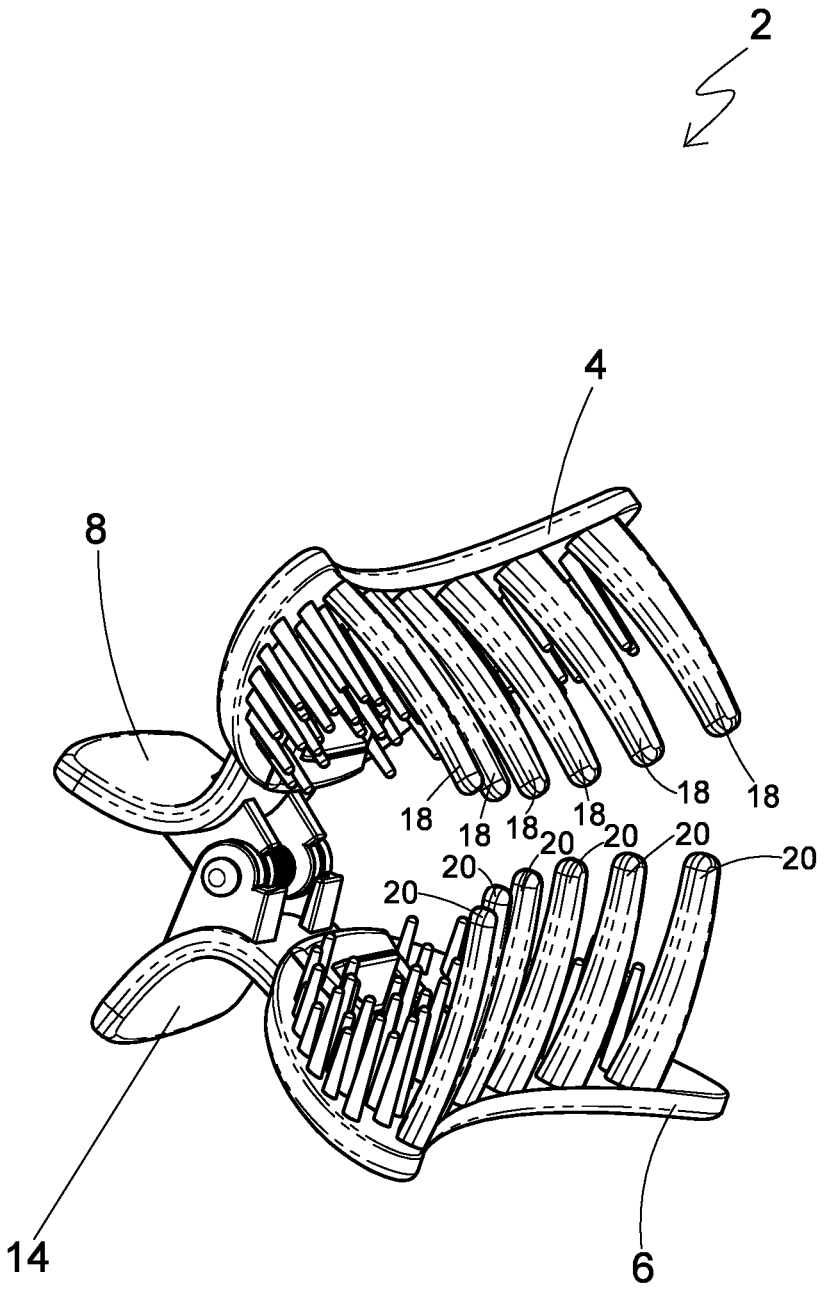
FIG. 8 is an alternative perspective view of the hair clip of FIG. 7 but in an open configuration.

FIG. 7, for example, illustrates the hair clip 2 in a default, or closed, configuration in which the first and second arms 4, 6 are biased together by a torsional wire spring. FIG. 8 illustrates the hair clip 2 in an open configuration in which the first and second handle members 8, 14 are squeezed or otherwise brought together thus spreading apart the first and second arms 4, 6 so as to receive and accommodate a layer or a log of hair for securement. From FIGS. 7 and 8, for example, it is shown that the hair clip 2 comprises a plurality of claw members 18, 20 in the form of relatively long teeth extending from respective distal ends of the first and second arms 4, 6. Specifically, at default, the claw members 18, 20 from the first and second arms 4, 6 are arranged alternately, and complementarily, to each other, and they together define an outwardly claw surface. The first and second arms 4, 6 together with the claw members 18, 20 resemble a pair of jaws. FIG. 7 illustrates that when the clip 2 assumes a closed configuration. The alternately arranged claw members 18, 20 together define an outwardly facing concave surface. It can be envisaged that in use, hair is accommodated in a cavity defined between the first and second arms 4, 6, and between the claw members 18, 20 and a hinge at which the torsional wire spring is located.

Figure 9:
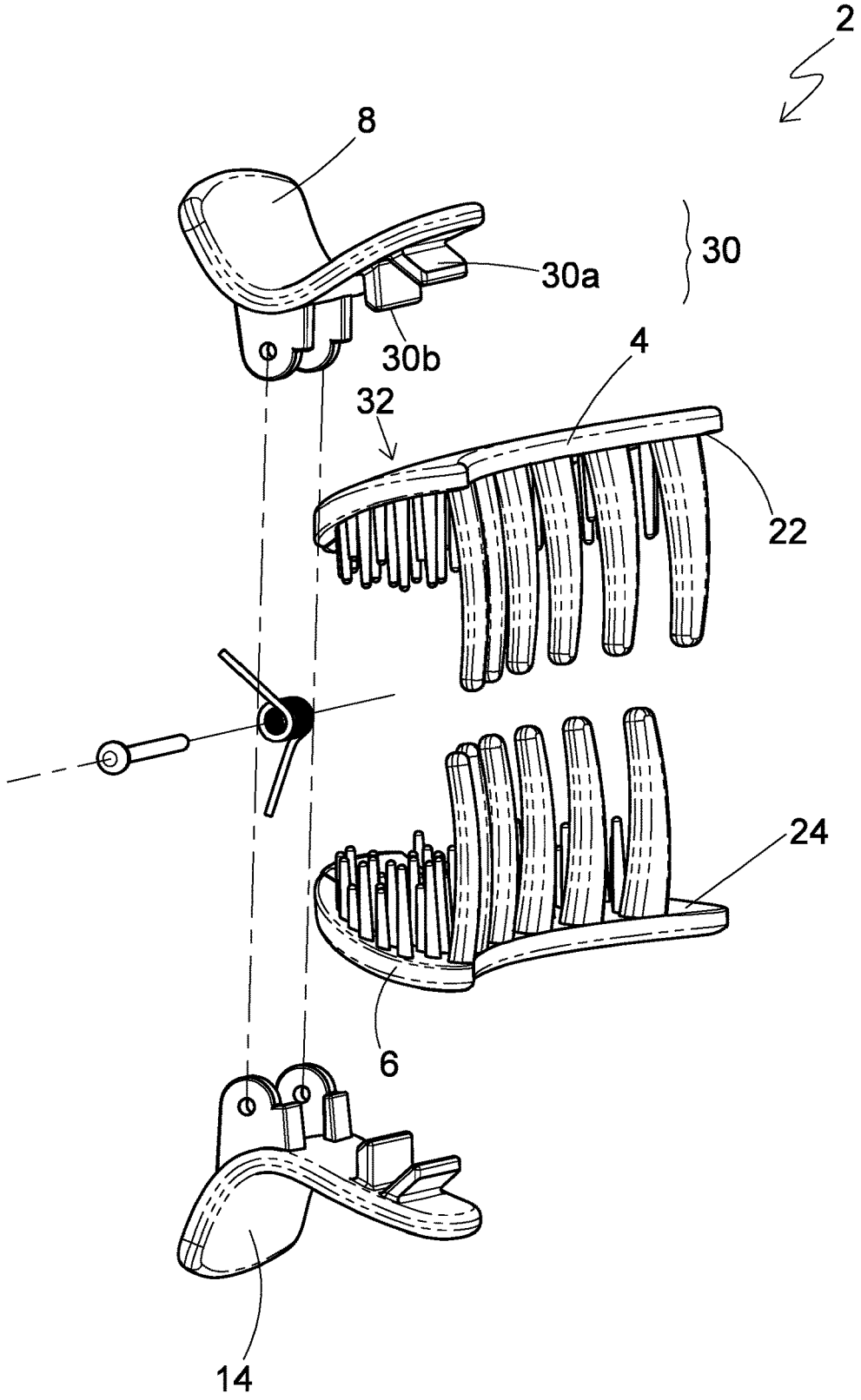
FIG. 9 is an exploded view of the hair clip of FIG. 7.

Referring to FIGS. 7 to 9, each of the first and second arms 4, 6 is provided with an inwardly facing surface 22/24. The inwardly facing surfaces 22, 24 of the arms 4, 6 face each other. The hair clip 2 further comprises a plurality of spike members extending from the inwardly facing surfaces 22, 24. It can be seen that when the hair clip 2 assumes a closed configuration, the arms 4, 6 are brought towards each other and the spikes members from the first arm 4 and the second arm 6 are pointing at each other, but are however not in contact or do not overlap with each other.

FIG. 9 is an exploded view showing the hair clip 2. It is shown that the first handle member and the first arm are two discrete components or two molded components, formed separately. In this embodiment, the first handle 8 is provided with a protrusion 30 including a pair of diverging legs 30*a*, 30*b* extending from an inwardly facing surface thereof. The first arm 4 is provided with a complementary through aperture 32 for receiving the protrusion 30. During assembly, the pair of legs 30*a*, 30*b* are slightly deformed and brought together thus allowing them to enter the through aperture 32. After the pair of legs 30*a*, 30*b* has entered the through aperture 32, they resume to their default diverging configuration whereby the first arm 4 is immovably secured to the first handle 8 with the legs 30*a*, 30*b* secured at the through aperture 32. Please also see FIG. 11. The second handle member 14 and the second arm 6 are similarly constructed as the first second handle and the second arm, respectively.

Figure 10:
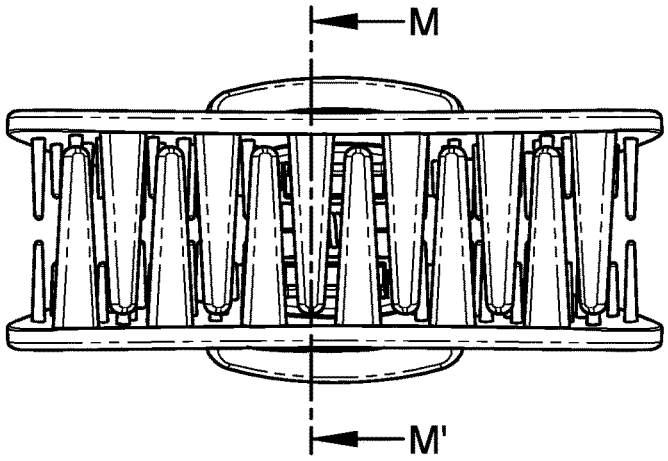
FIG. 10 is a schematic diagram of the hair clip of FIG. 7 in a default closed configuration.
Figure 11:
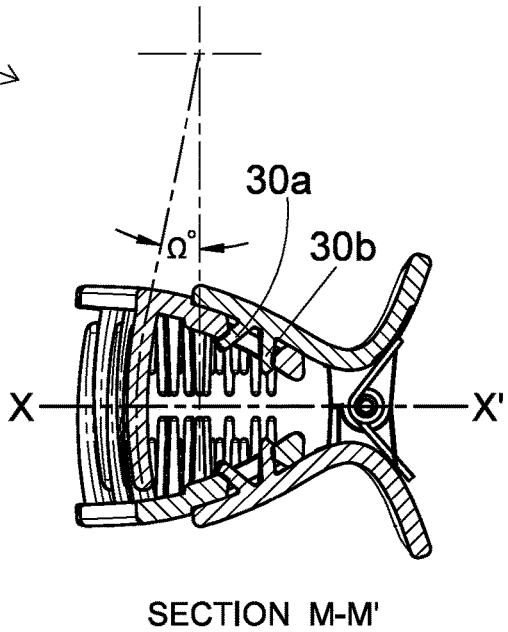
FIG. 11 is a cross section view taken at line M-M' of FIG. 10.
Figure 12:
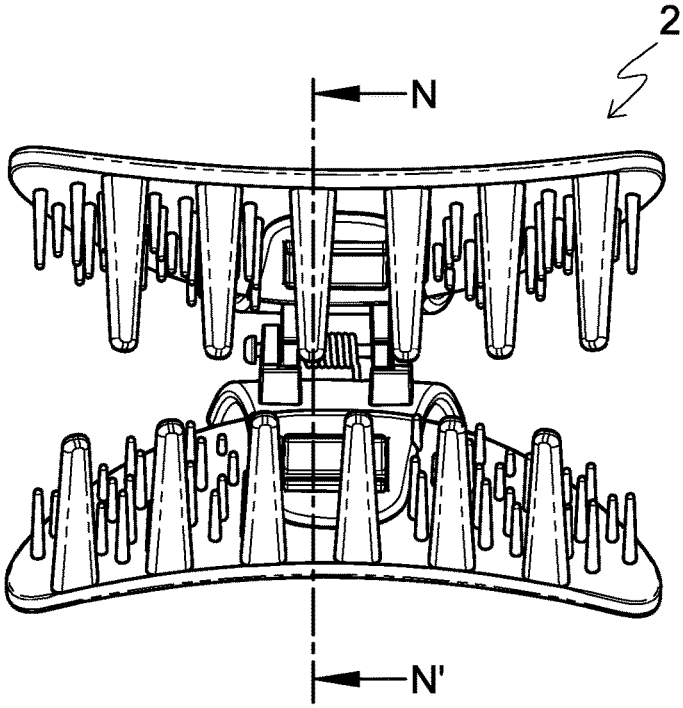
FIG. 12 is schematic diagram of the hair clip of FIG. 8 in an open configuration.
Figure 13:
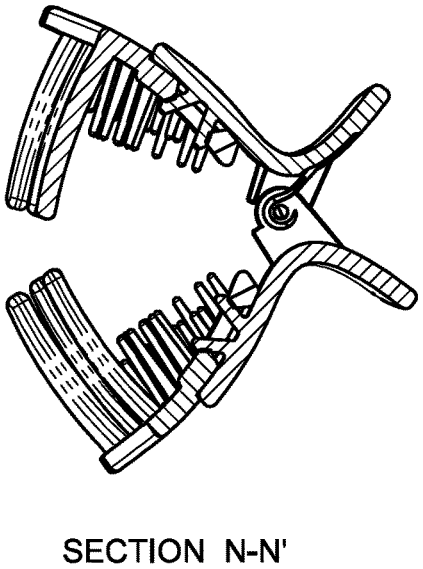
FIG. 13 is a schematic diagram showing a cross section view taken at line N-N' of FIG. 10.

FIG. 10 is a front view of the hair clip 2, and FIG. 11 is a cross section view taken at line M-M' of FIG. 10. FIG. 11 shows that the claw members 18, 20 together define a curved outwardly facing surface which has a slightly convex profile. This configuration of the claw members 18, 20 provides more room in the cavity for accommodating hair. The spike members assume a substantially straight profile. The spike members essentially extend in a direction perpendicular to an axis X-X' at and along which the first and second handles 8, 14 pivot. FIG. 12 and FIG. 13 similarly illustrate the profile and configuration of the claw members 18, 20 and spike members.

Figure 14:
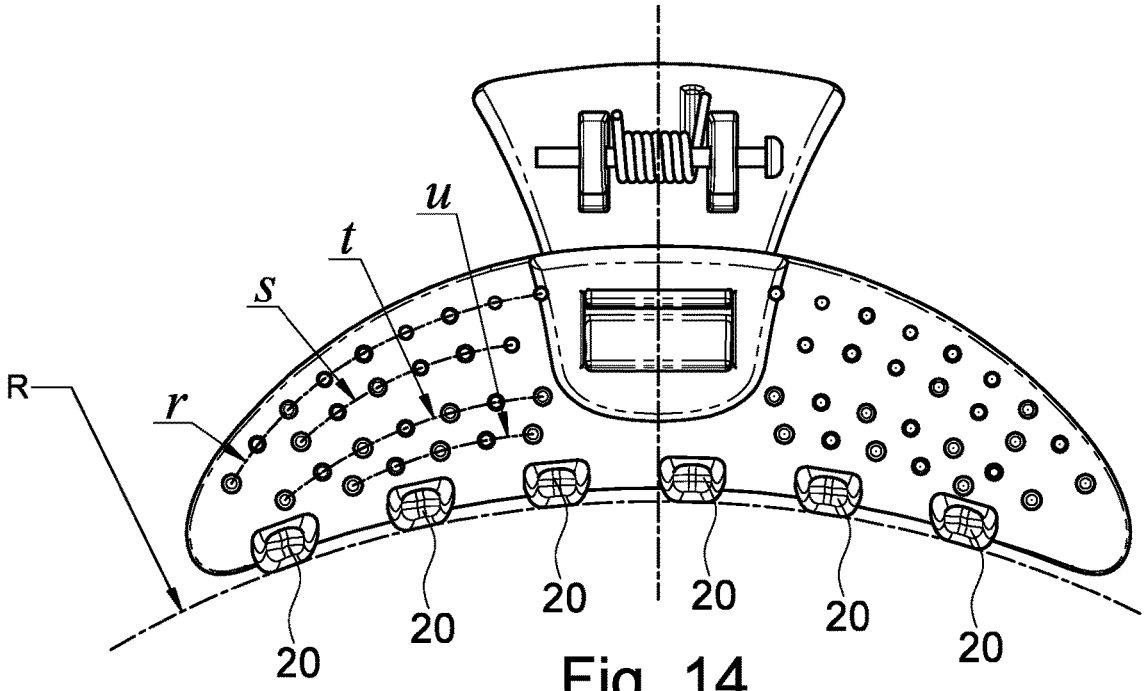
FIG. 14 is a schematic diagram of the hair clip of FIG. 7 illustrating arrangement of claw members and different spike members thereof.
Figure 15:
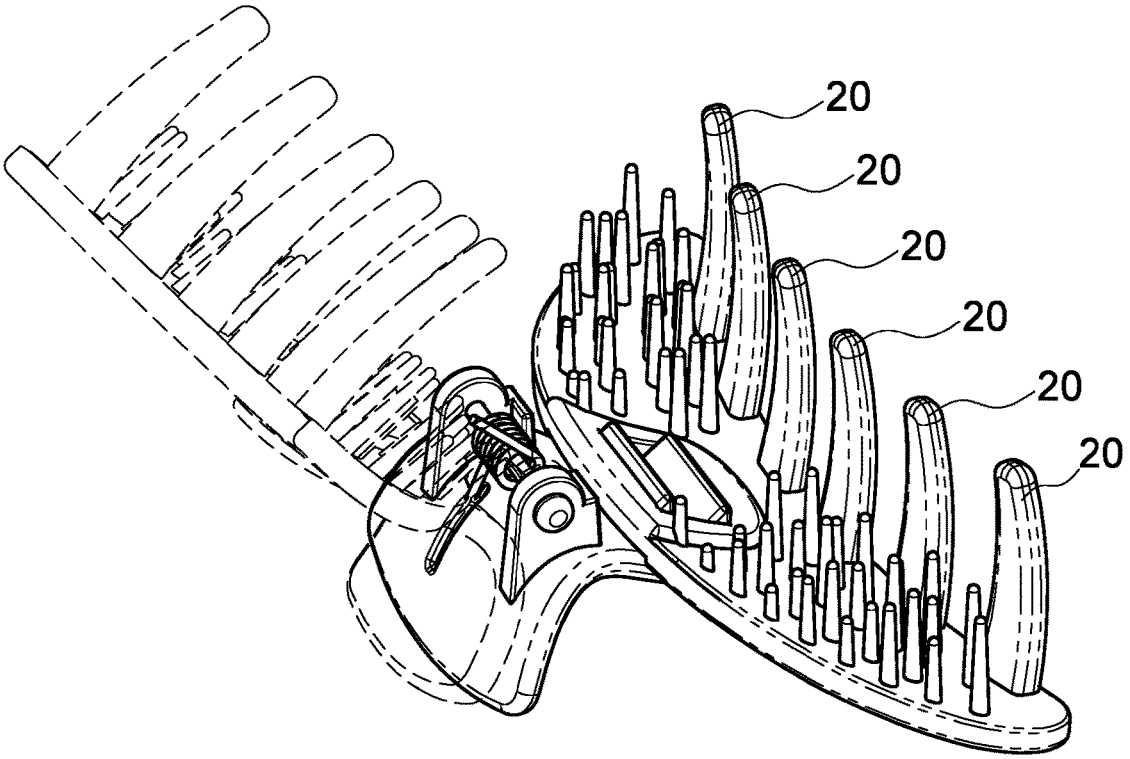
FIGS. 15 and 16*a* to 16*e* are schematic diagrams of the hair clip of FIG. 7 illustrating arrangement of one of the claw members and the spike members thereof.

FIGS. 14 and 15 show the hair clip 2 and in particular the spike members of the second arm 6 in greater detail. FIG. 14 is a schematic diagram of a view from above of the second arm 6 and FIG. 15 is a schematic diagram showing of a perspective view of the second arm 6. Although the second arm 6 includes a plurality of spikes extending from its inwardly facing surface, these spikes have a number of characteristics. The spikes are arranged in a plurality of rows. Specifically, in this embodiment, the spikes are arranged in four rows. Please see the four lines r, s, t, u. The spikes in each row however are not presented in a straight line but a slightly curved line corresponding to the outline of the second arm. It is to be noted that the claw members 20 are substantially longer than the spike members.

Figure 16A:
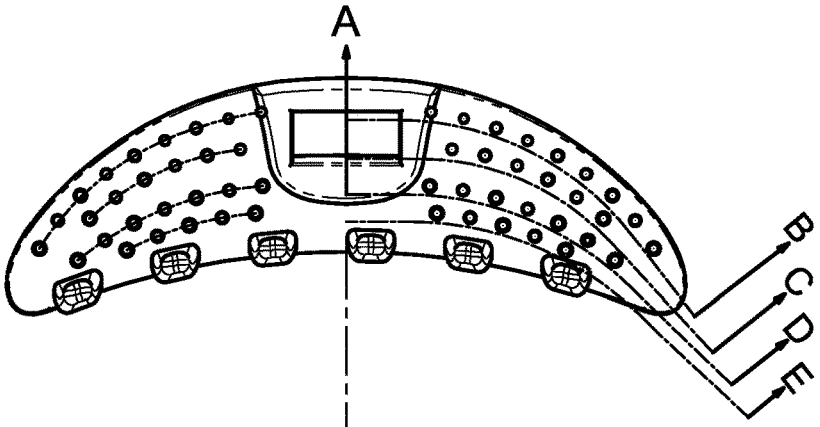
Figure 16B:
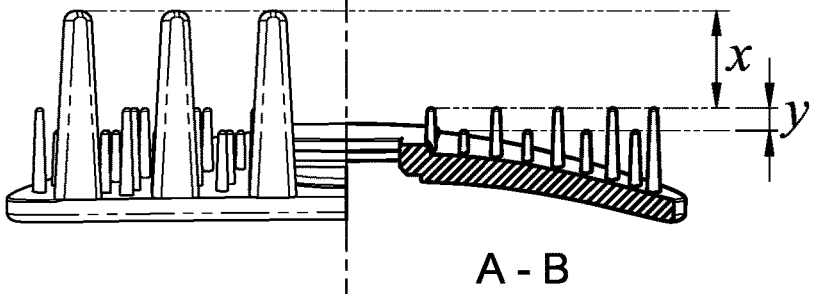
Figure 16C:
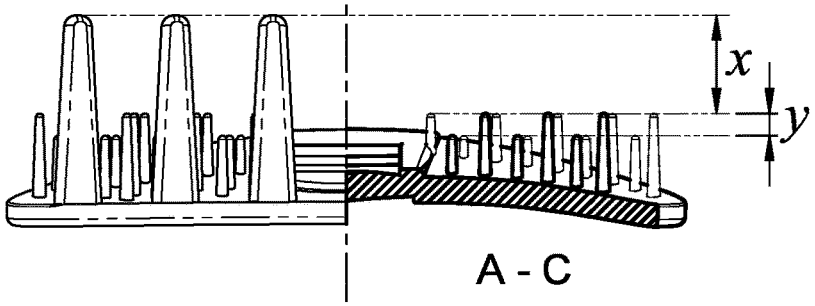
Figure 16D:
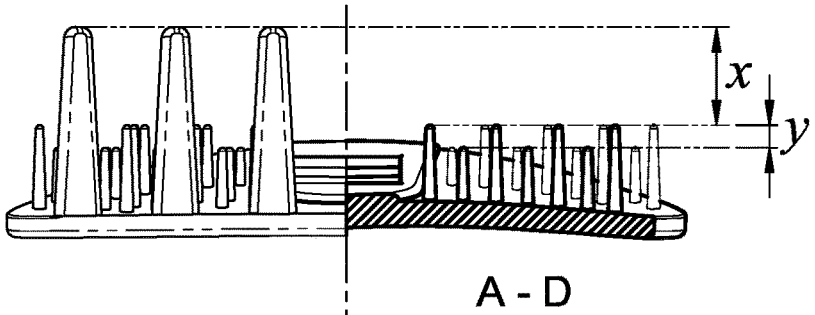
Figure 16E:
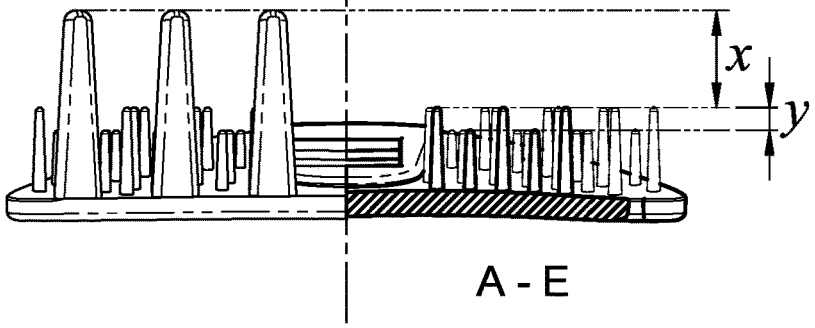

FIGS. 16*a*-16*e* illustrate that the spike members arranged on the same row do not have the same length. Specifically, FIG. 16*b* is a cross section view taken at A-B of FIG. 16*a*, FIG. 16*c* is a cross section view taken at A-C of FIG. 16*a*, FIG. 16*d* is a cross section view taken at A-D of FIG. 16*a* and FIG. 16*e* is a cross section view taken at A-E of FIG. 16*a*. Spike members with different lengths are presented by different circles of different sizes. Please see FIG. 16*a*. It is however to be noted that although in each row the longer and shorter spike members are arranged alternately, it does not mean that the spike members from all rows only have two lengths. In this embodiment, the spike members of the different rows have at least eight lengths. Please see for example FIG. 16*b*.

FIGS. 16*a*-16*e* also illustrate the curvature of the inwardly facing surface of the second arm 6. It is shown that the curvature of the inwardly facing surface at different locations is different. It means that the inwardly facing surface of the second arm is non-planar.

Despite the difference in length of the spike members and the inwardly facing surface from which the spike members extend, the spike members can be categorized into two groups, namely a first group and a second group or first spikes and second spikes. In the first group distal ends of the (first) spike members define a first plane, while in the second group distal ends of the (second) spike member define a second, different, plane. The first plane is closer to axis X-X' compared to the second plane.

The first arm 4 is provided with spike members with similar configuration. Please see for example FIG. 15. It is however to be noted that at the default configuration the spike members from the first arm and the spike members from the second arm do not overlap with each other. There is a clearance between the spike members from the first arm and the spike members from the second arm.

The first and second arms are made of a first material, and the first and second handle members are made of a second material stiffer than the first material. The use of a stiffer material for the first and second arms is to provide sturdier handles for controlling the first and second arms. The use of softer first and second arms provides more flexibility for securing hair and to provide better contact comfort to the hair. In this embodiment, the first material is selected from the group consisting of polypropylene (PP), general purpose polystyrene polymer (GPPS), high impact polystyrene (HIPS), acrylic, polycarbonate (PC), acrylonitrile butadiene (ABS), nylon, polyoxymethylene (POM) and acetate, and the second material is selected from the group consisting of polypropylene (PP), general purpose polystyrene polymer (GPPS), high impact polystyrene (HIPS), acrylic, polycarbonate (PC), acrylonitrile butadiene (ABS), nylon, polyoxymethylene (POM) and acetate.

The first arm, its claw member and spike members are made of one integral component of the same material. Likewise, the second arm, its claw member and spike members are also made of one integral component of the same material. On the other hand, the first handle member is made of another integral component of a different material. Likewise, the second handle member is made of another integral component of a different material.

The hair clip 2 comprises a first connector for securing the first arm to the first handle member. As illustrated above, the first connector includes the protrusion with the two legs and the through aperture. Likewise, the hair clip 2 comprises a second connector for securing the second arm to the second handle member, and includes its respective protrusion with two legs and through aperture.

As explained above, the spike members can be categorized into two groups. One characteristic is that the first spike members of the first arm become progressively shorter towards a rear end of the first arm, the second spike members of the first arm become progressively shorter towards the rear end of the first arm, the first spike members of the second arm are become progressively shorter towards a rear end of the second arm, and the second spike members of the second arm become progressively shorter towards the rear end of the second arm.

FIG. 11 shows that the first spike members of the first arm have a length less than half of the length of the first claw members. It can also be seen that the first claw members, and the first and second spike members of the first arm, generally extend in a first direction or the same direction, and the second claw members, and the first and second spike members of the second arm, generally extend in a direction opposite to the first direction. However, the first claw members, and the first and second spike members, of the first arm, extend in different directions, the second claw members, and the first and second spike members, of the second arm, extend in different directions, and the first and second spike members of the first and second arms are oriented towards the first and second handle members.

Figure 17:
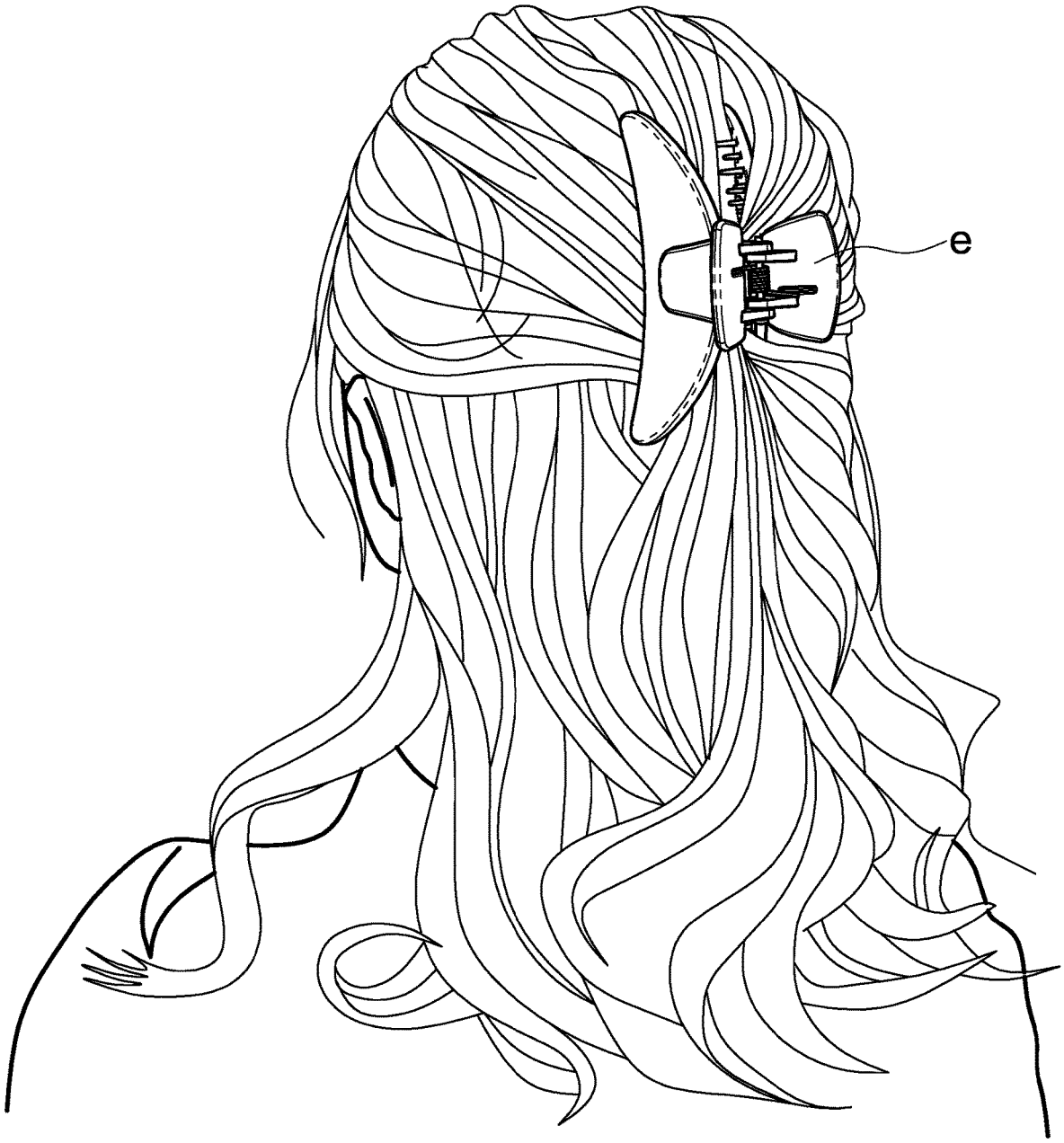
FIG. 17 is a schematic diagram showing the use of the hair claw of FIG. 1, FIGS. 18 and 21 are top and bottom views of a second embodiment of a hair clip in according to the present invention, respectively.
Figure 18:
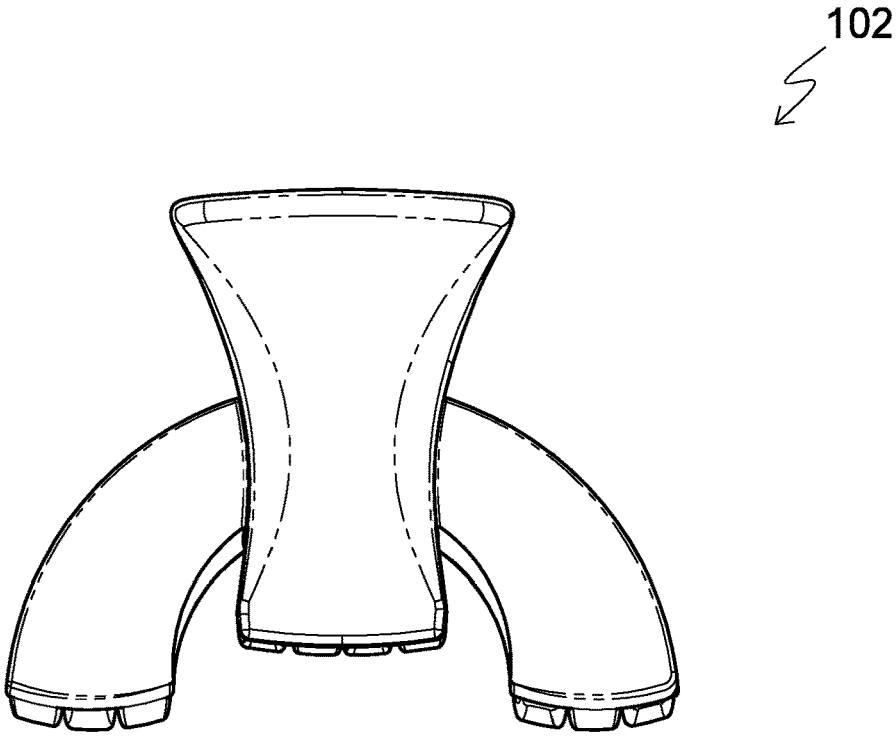
Figure 19:
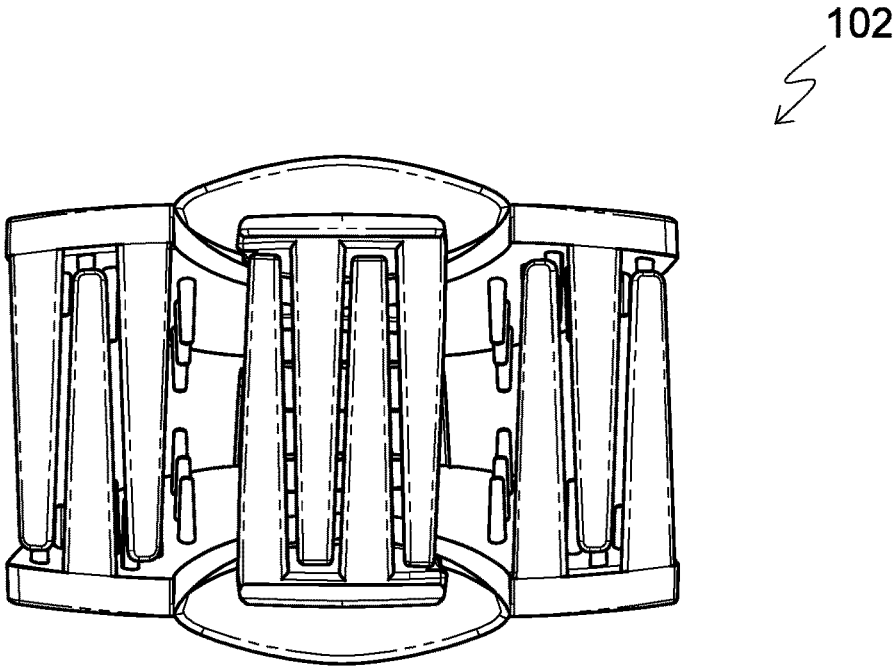
FIGS. 19 and 20 are front and rear views of the hair clip of FIG. 18, FIGS. 22 and 23 are opposite (lateral) side views of the hair clip of FIG. 18.
Figure 20:
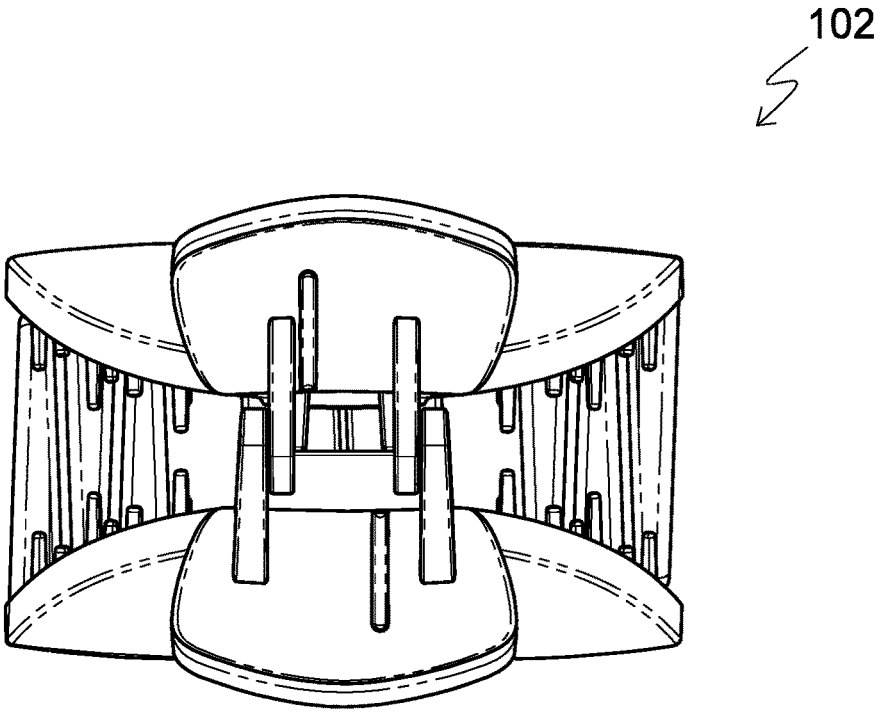
Figure 21:
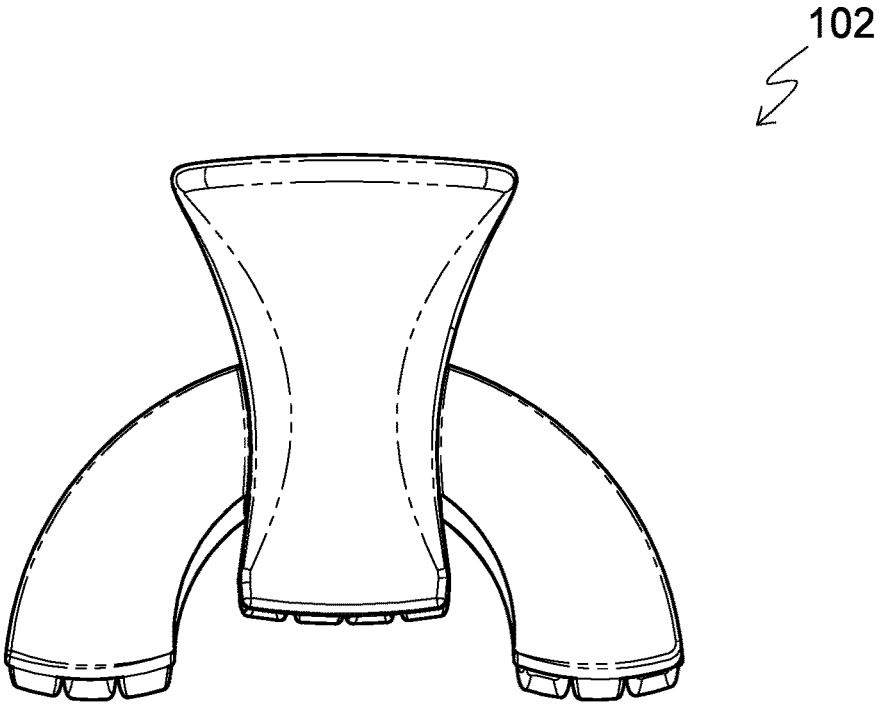
Figure 22:
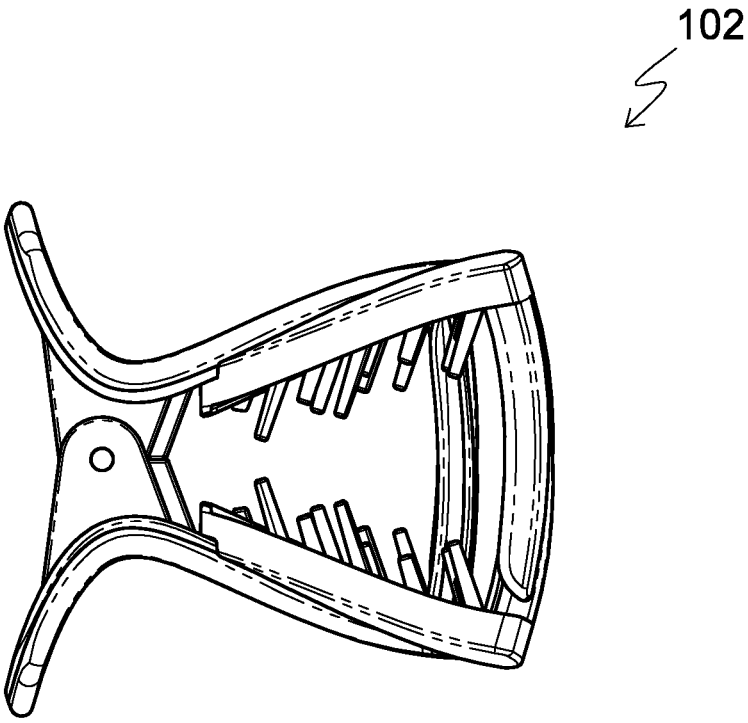
Figure 23:
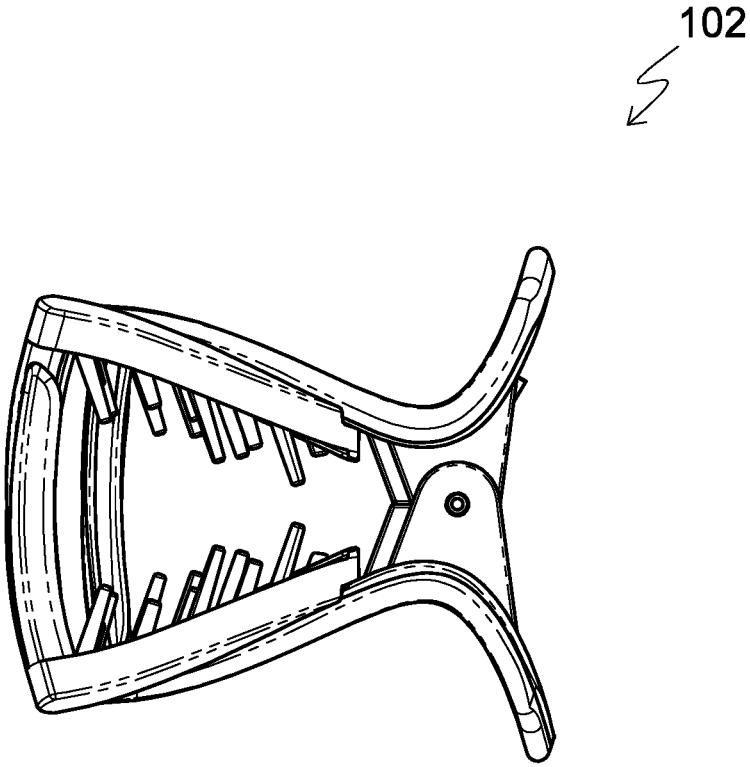

FIG. 17 illustrates the hair clip 2 in use. When the hair clip 2 is used to secured a layer or a log of hair, the layer or the log of hair is accommodated in the cavity defined between the claw members and the hinge. The spike members serve to further secure the hair between the arms by way of penetrating the hair. Since there are two groups of spike members which have a plurality of lengths, the spike members penetrate the hair in different extents and thus the entire layer or log of hair is secured to a significantly larger extent.

FIGS. 18-34 illustrate a second embodiment of a hair clip 102 of the present invention. In particular, FIGS. 18-24 are six orthogonal views and a perspective view of the hair clip 102. The hair clip 102 and the hair clip 2 are similar in some aspects although there are differences. The following description focuses on the differences of the hair clip 102.

Figure 24:
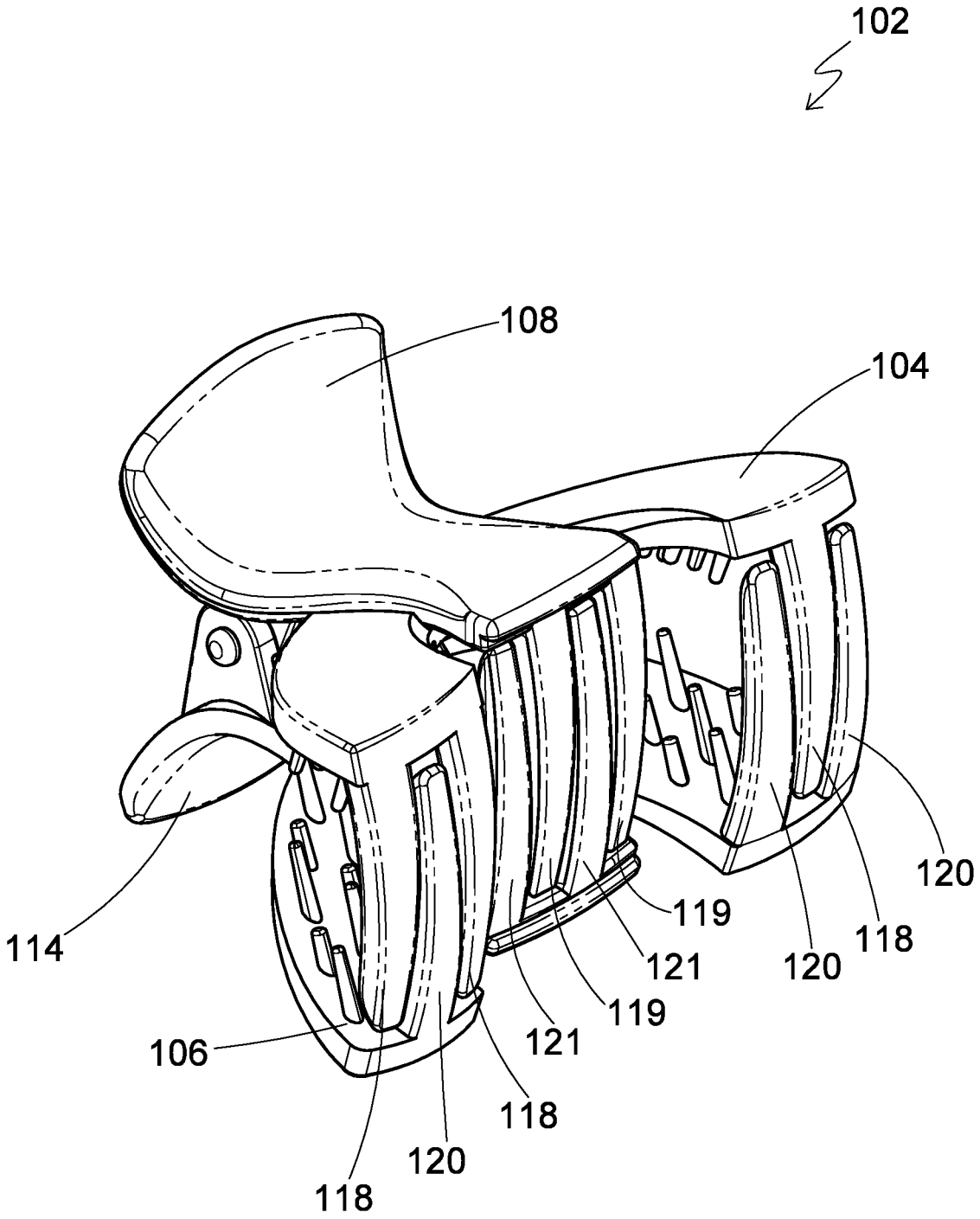
FIG. 24 is a perspective view of the hair clip of FIG. 18.
Figure 25:
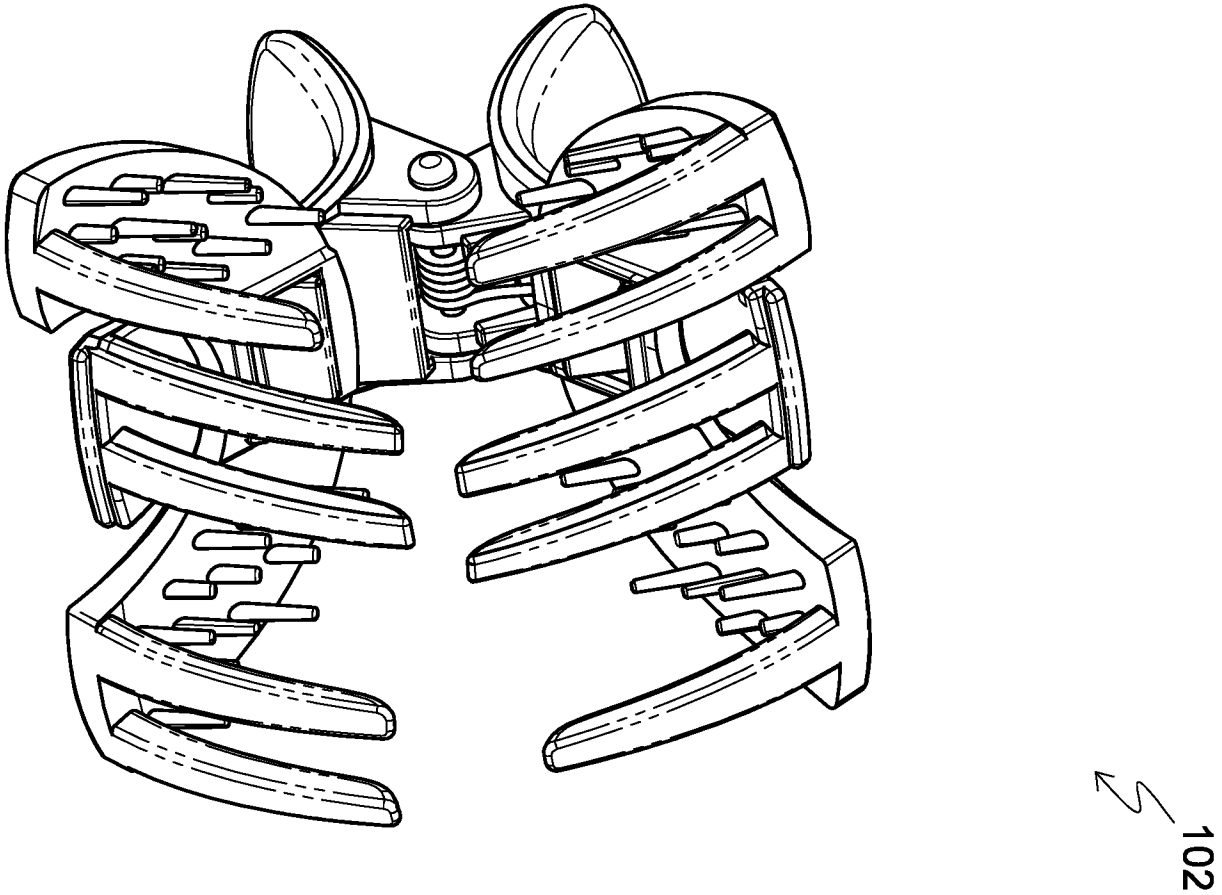
FIG. 25 is an alternative perspective view of the hair clip of FIG. 24 but in an open configuration.

Referring to FIG. 24, the hair clip 102 comprises a first handle member 108 and a second handle member 114 pivotably connected to the first handle member 108. The hair clip 102 also comprises a first arm 104 connected the first handle member 108 and a second arm 106 connected to the second handle member 114. Both the first arm 104 and the second arm 106 are provided with claw members 118, 120 extended transversely from the respective distal ends thereof. The claw members 118 of the first arm 104 and the claw members 120 of the second arm 106 point towards each other and at default configuration of the hair clip 102, the claw members 118, 120 of the first and second arms 104, 106 are arranged alternately. Inwardly facing surfaces of the first and second arms 104, 106 are also provided with a plurality of spikes extending thereof.

Figure 26:
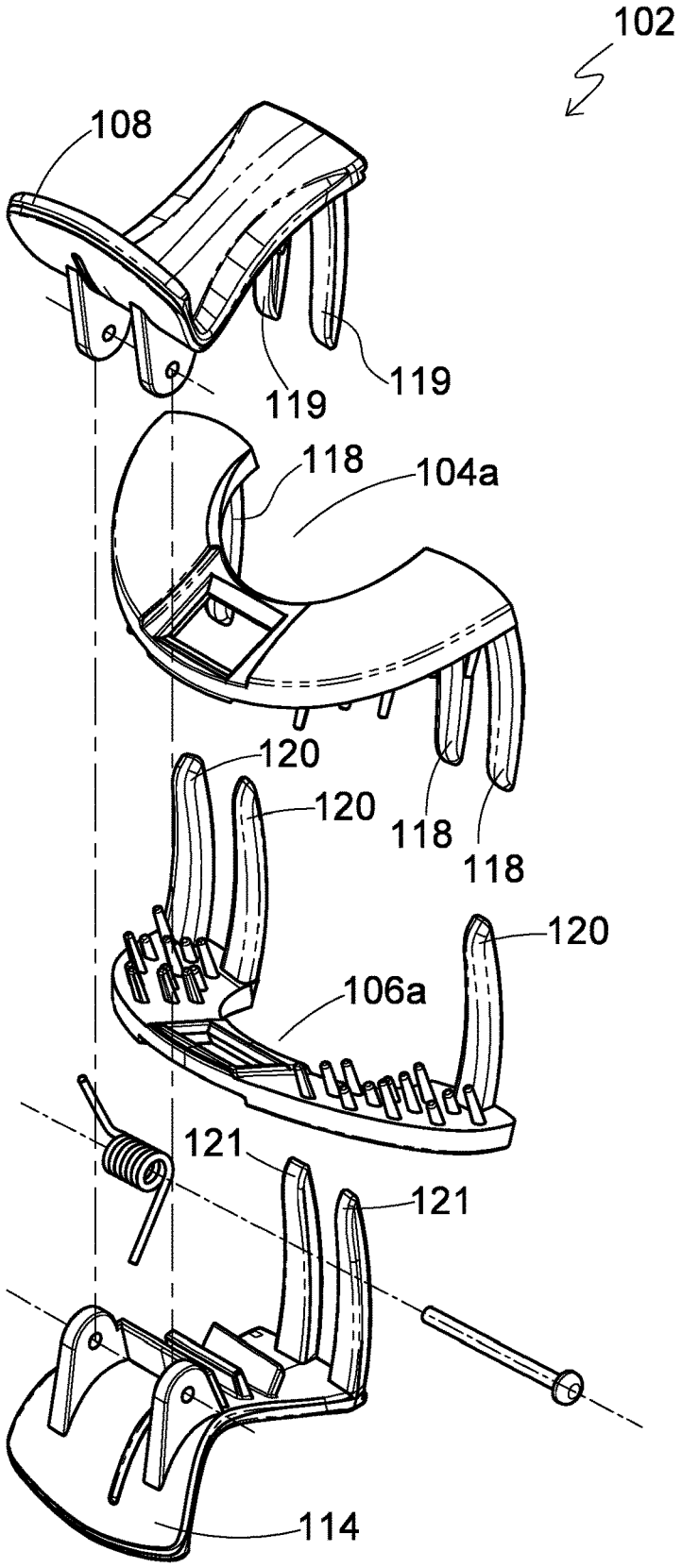
FIG. 26 is an exploded view of the hair clip of FIG. 24.

One difference of the hair clip 102 is that, compared to the first and second handle members 8, 14 of the hair clip 2, the first and second handle members 108, 114 are enlarged and they reach out and extend forward beyond the respective first and second arms 104, 106. Referring to FIG. 26, for example, the first and second arms 104, 106 are also different in that they are provided with a cutout region 104*a*/106*a* in the form of a recess. While both the first and second arms 104, 106 are provided with a plurality of claw members 118, 120 the first and second handle members 108, 114 are also provided with claw members 119, 121 extended from their respective distal ends. In this embodiment, each of the first and second handle members 108/114 is provided with a pair of claw members 119/121 from its distal end. Please also see FIGS. 14-25.

Figure 27A:
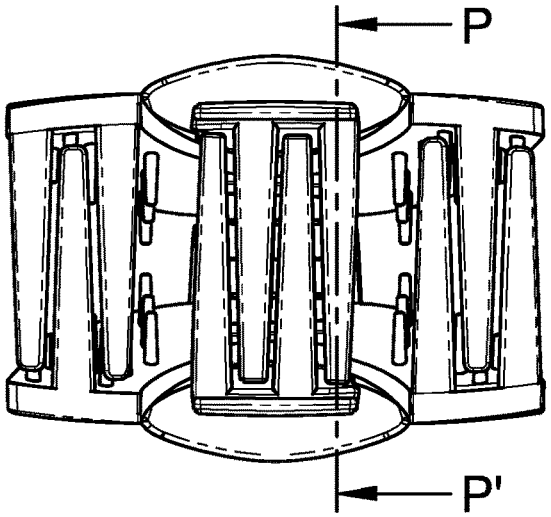
FIG. 27*a* is a schematic diagram showing the hair clip of FIG. 24.
Figure 27B:
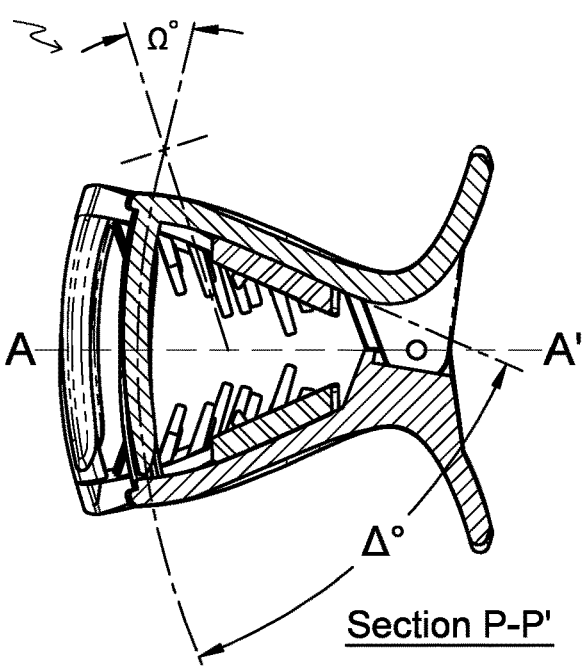
FIG. 27*b* is a schematic diagram showing a cross section view taken at line P-P' of FIG. 27*a*.

FIG. 27*a* is a front view of the hair clip 2, and FIG. 27*b* is a schematic cross section view taken at P-P' of FIG. 27*a*. FIG. 27*b* shows that the spike members of the hair clip 102 are different in that the spike members from opposite arms do not point towards each other. Instead, they all point towards a hinge portion of the hair clip 102. In other words, they spike members are not arranged perpendicularly to an axis A-A' of a transverse plane defined by the hinge.

Figure 28A:
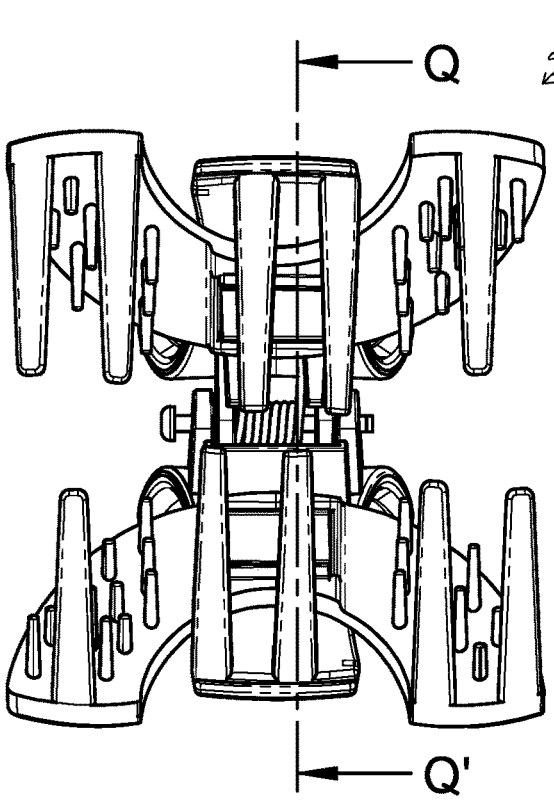
FIG. 28*a* is a schematic diagram showing the hair clip of FIG. 27*a* but assuming an open configuration.
Figure 28B:
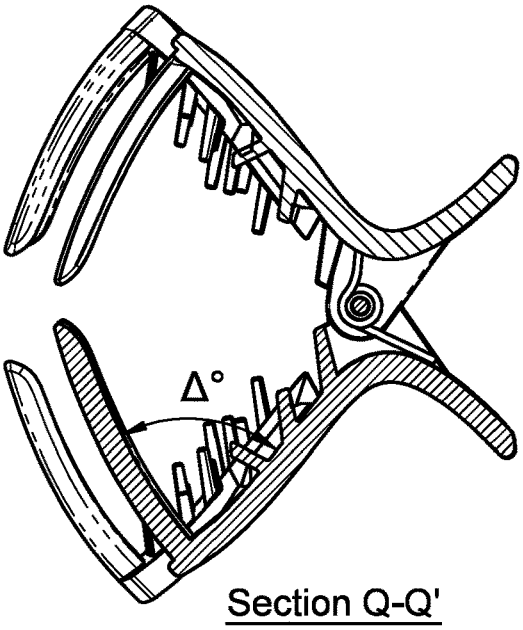
FIG. 28*b* is a schematic diagram showing a cross section view taken at line Q-Q' of FIG. 28*a*.

FIG. 28*a* is a front view of the hair clip 102 but assuming an open configuration, and FIG. 27*b* is a schematic cross section view taken at Q-Q' of FIG. 28*a*. From FIGS. 27*a*-28*b*, it can be been seen that both the claw members 118, 120 extend from the first and second arm 104, 106 and the claw members 119, 121 extended from the first and second handle members 108, 114 are slightly curved inwardly and define an arc, while the spike members point away from the claw members 118, 119, 120, 121. The claw members 119, 121 of the first and second handle members 108, 114 are recessed compared to the claw members 118, 120 of the first and second arms 104, 106.

Figure 29A:
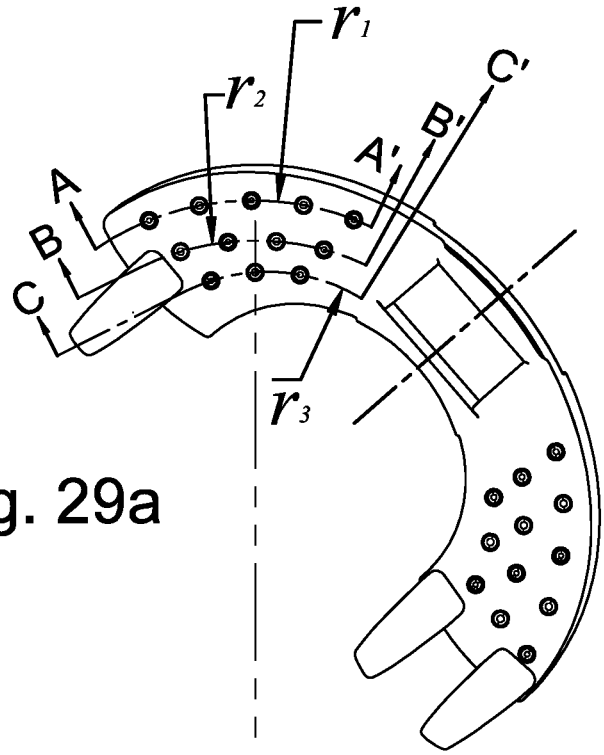
FIG. 29*a* is a schematic diagram showing the hair clip of FIG. 24 with claw members and different spike members.
Figure 29B:
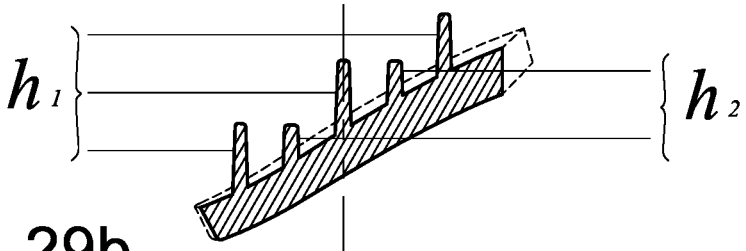
FIGS. 29*b* to 29*d* are schematic diagrams showing the different spike members of the hair clip of FIG. 24, FIGS. 30 to 33 are schematic diagrams showing the profile and arrangement of the claw members and spike members of FIG. 24.
Figure 29C:
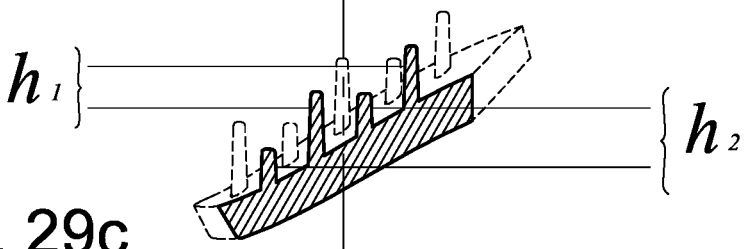
Figure 29D:
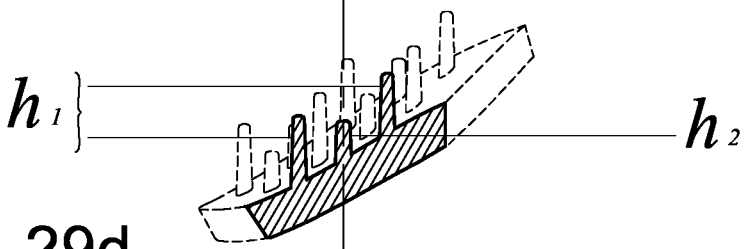
Figure 30:
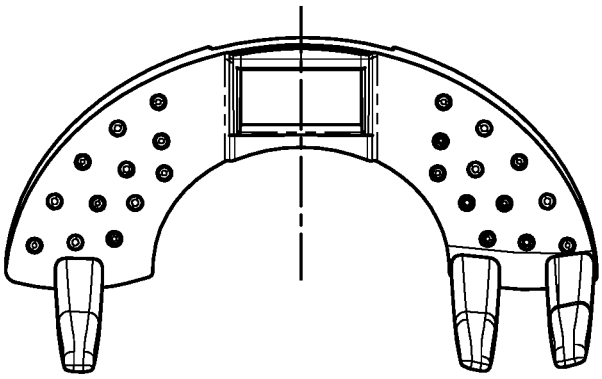
Figure 31:
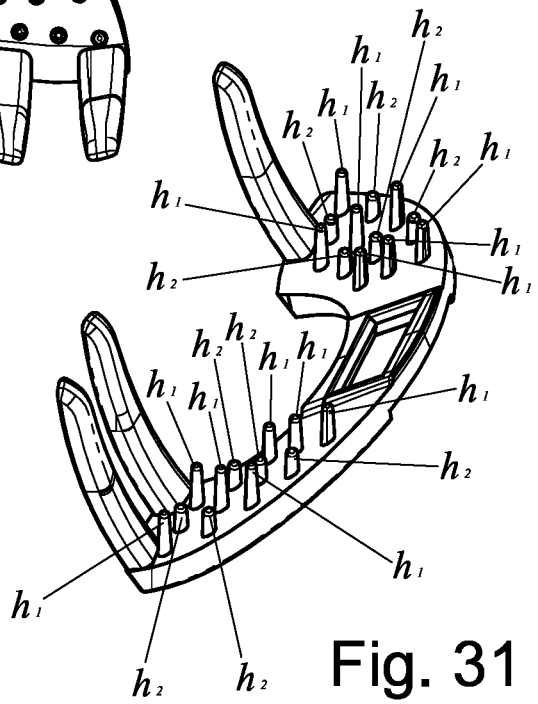
Figure 32:
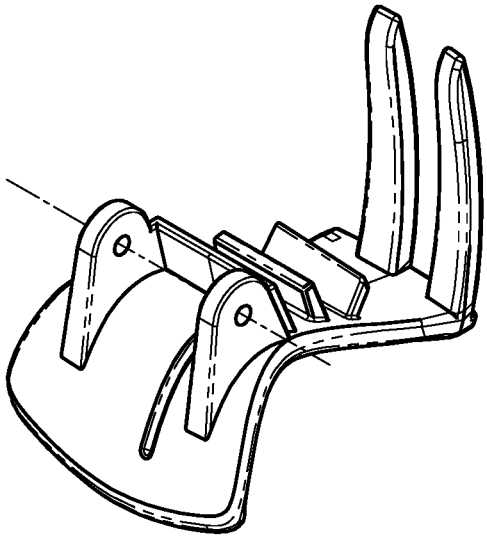
Figure 33:
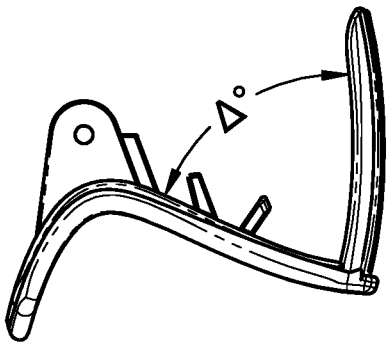

FIG. 29*a* shows that the spike members are presented in three rows laterally along the curvature of the second arm, namely rows A-A', B-B', and C-C'. FIGS. 29*b*, 29*c* and 29*d* show the length of the spike member in rows A-A', B-B', and C-C', respectively. FIG. 29*b* shows that the spike members in row A-A' have two lengths, namely length $h_1$ and $h_2$; the spike members in row B-B' have two lengths, namely length $h_1$ and $h_2$; and the spike members in row C-C' have two lengths, namely length $h_1$ and $h_2$. In alternative embodiments, the spike members may have at least two lengths, e.g. three to eight lengths. FIGS. 30-33 further illustrate the profile of the spike members. FIG. 29*b*, for example, shows that distal ends of the longer spike members define a first plane and distal ends of the shorter spike members define a second plane. FIG. 27*b* shows that the spike members from opposite arms do not overlap with each other.

Figure 34:
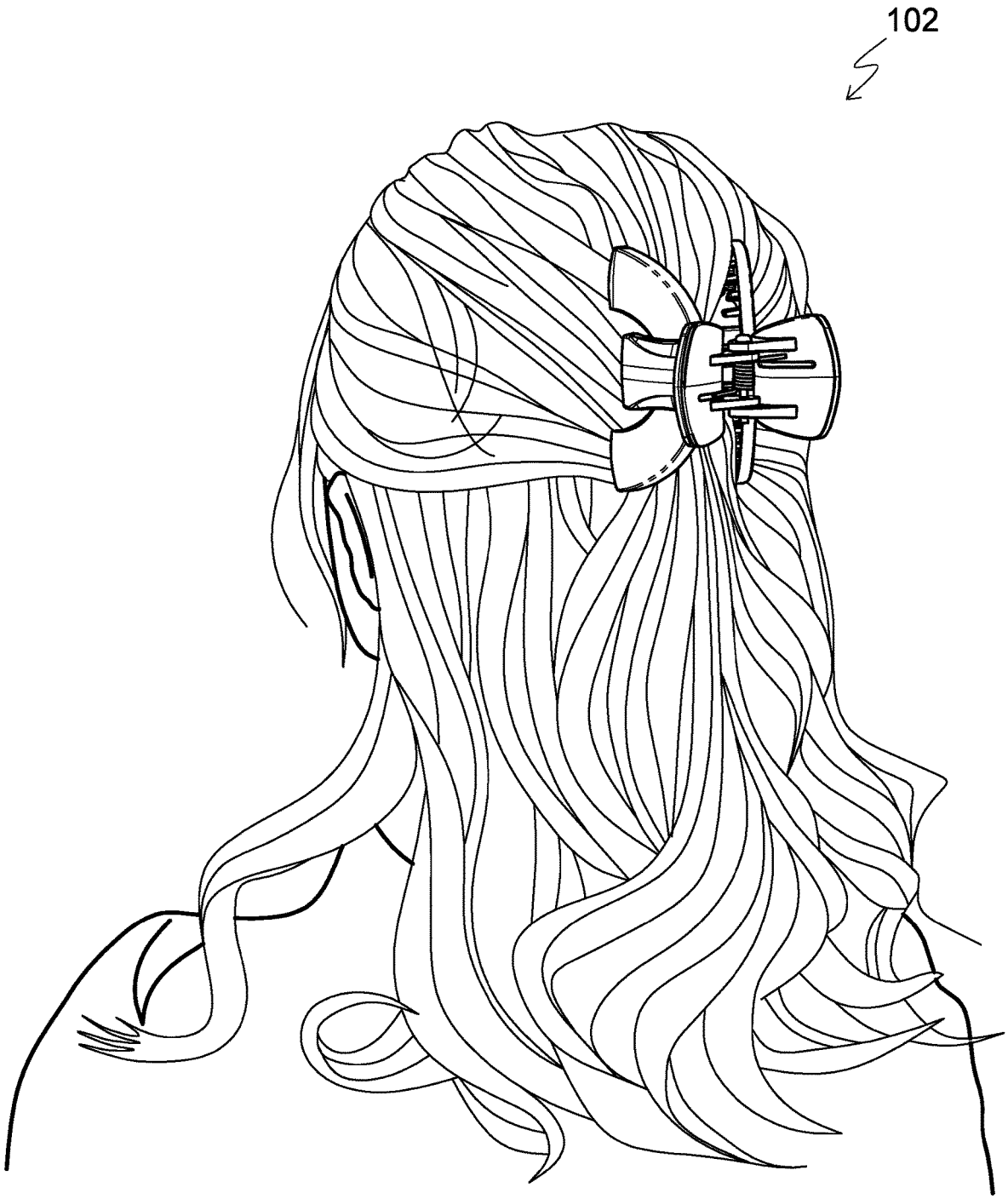
FIG. 34 is a schematic diagram showing the hair claw of FIG. 24.

FIG. 34 illustrates the hair clip 102 in use. When the hair clip 102 is used to secured a layer or a log of hair, the layer of the log of hair is accommodated in the cavity defined between the claw members of the first and second arms and the hinge. The claw members of the first and second handle members and the spike members serve to further secure the hair between the arms by way of penetrating the hair. Since there are two groups of spike members which have a plurality of lengths, they spike members penetrate the hair in different extents and thus the entire layer or log of hair is secured to a larger extent. Further, since the spike members point towards the hinge, the hair accommodated is better held and secured towards the hinge within the hair clip 102.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose.

What is claimed is:

1. A hair clip device comprising:

a first arm defining an inwardly facing surface and provided with a plurality of claw members, a second arm defining an inwardly facing surface and provided with a plurality of claw members, wherein at default the claw members of the first arm and the second arm are arranged alternately and complementarily, and a first handle member connected to an outwardly facing surface of the first arm, and a second handle member connected to an outward facing surface the second arm, the first and second handle members pivotably connected together and cooperatively configured for controlling relative movement of the first and second arms, and first and second spikes members extending from the inwardly facing surface of the first and second arms, wherein:

the claw members of the first arm are substantially longer than the first and second spike members, and the first and second spike members are of different length, the first handle member, the second handle member, the first arm and the second arm made of separate discrete components, the first and second arms are made of a first material, and the first and second handle members are made of a second material stiffer than the first material whereby the stiffer second material provides sturdiness to the first and second handles while the less stiff first material provides better contact comfort to hair, and the first spike members of the first arm become progressively shorter towards a rear end of the first arm, the second spike members of the first arm become progressively shorter towards the rear end of the first arm, the first spike members of the second arm become progressively shorter towards a rear end of the second arm, and the second spike members of the second arm become progressively shorter towards the rear end of the second arm, for improving tightness in hair securing by the hair clip device.

2. A device as claimed in claim 1, wherein the first material is selected from the group consisting of polypropylene (PP), general purpose polystyrene polymer (GPPS), high impact polystyrene (HIPS), acrylic, polycarbonate (PC), acrylonitrile butadiene (ABS), nylon, polyoxymethylene (POM) and acetate, and the second material is selected from the group consisting of polypropylene (PP), general purpose polystyrene polymer (GPPS), high impact polystyrene (HIPS), acrylic, polycarbonate (PC), acrylonitrile butadiene (ABS), nylon, polyoxymethylene (POM) and acetate.

3. A device as claimed in claim 2, wherein the first arm, the claw members of the first arm and the first and second spike members of the first arm are made of the first material, and the claw members of the second arm, the second arm and the first and second spike members of the second arm are also made of the first material.

4. A device as claimed in claim 1, comprising a first connector for securing the first arm to the first handle member, and a second connector for securing the second arm to the second handle member.

5. A device as claimed in claim 4, wherein:

the first handle member is provided with a protrusion including a pair of diverging legs extending from an inwardly facing surface thereof, and the second handle member is provided with a protrusion including a pair of diverging legs extending from an inwardly facing surface thereof, the first arm is provided with a complementary aperture in which the protrusion of the first handle member is received, and the second arm is provided with a complementary aperture in which the protrusion of the second handle member is received.

6. A device as claimed in claim 1, wherein:

the inwardly facing surface of the first arm is non-planar, and the inwardly facing surface of the second arm is non-planar.

7. A device as claimed in claim 1, wherein, at default:

the first spike members of the first arm and the first spike members of the second arm do not overlap with each other, and the second spike members of the first arm and the second spike members of the second arm do not overlap with each other, whereby a clearance is provided between the spike members from the first and second arms.

8. A device as claimed in claim 1, wherein the first spike members of the first arm have a length less than half of the length of the first claw members, and the first spike members of the second arm have a length less than half of the length of the first claw members.

9. A device as claimed in claim 1, wherein the first claw members and the first and second spike members of the first arm generally extend in a first direction or the same direction, and the second claw members and the first and second spike members of the second arm generally extend in a direction opposite to the first direction.

10. A device as claimed in claim 1, wherein:

the first claw members, and the first and second spike members, of the first arm, extend in different directions, the second claw members, and the first and second spike members, of the second arm, extend in different directions, and the first and second spike members of the first and second arms are oriented towards the first and second handle members.

11. A hair clip device comprising:

a first arm defining an inwardly facing surface and provided with a plurality of claw members, a second arm defining an inwardly facing surface and provided with a plurality of claw members, wherein at default the claw members of the first arm and the second arm are arranged alternately and complementarily, and a first handle member connected to the first arm, and a second handle member connected to the second arm, the first and second handle members pivotably connected together and cooperatively configured for controlling relative movement of the first and second arms, first and second spikes members extending from the inwardly facing surface of the first arm, wherein:

the first handle member, the second handle member, the first arm and the second arm made of separate discrete components, the first and second arms are made of a first material, and the first and second handle members are made of a second material stiffer than the first material, wherein the first material is selected from the group consisting of polypropylene (PP), general purpose polystyrene polymer (GPPS), high impact polystyrene (HIPS), acrylic, polycarbonate (PC), acrylonitrile butadiene (ABS), nylon, polyoxymethylene (POM) and acetate, and the second material is selected from the group consisting of polypropylene (PP), general purpose polystyrene polymer (GPPS), high impact polystyrene (HIPS), acrylic, polycarbonate (PC), acrylonitrile butadiene (ABS), nylon, polyoxymethylene (POM) and acetate, distal ends of the first spike members of the first arm extending from the inwardly facing surface of the first arm define a plane where the first spike members thereof end, distal ends of the second spike members of the first arm extending from the inwardly facing surface of the first arm define a plane where the second spike members thereof end, distal ends of the first spike members of the second arm extending from the inwardly facing surface of the second arm define a plane where the first spike members thereof end, distal ends of the second spike members of the second arm extending from the inwardly facing surface of the second arm define a plane where the second spike members thereof end, a clearance is provided between the spike members from the first arm and the spike members from the second arm, and the first spike members of the first arm become progressively shorter towards a rear end of the first arm, the second spike members of the first arm become progressively shorter towards the rear end of the first arm, the first spike members of the second arm become progressively shorter towards a rear end of the second arm, and the second spike members of the second arm become progressively shorter towards the rear end of the second arm, for improving tightness in hair securing by the hair clip device.

12. A device as claimed in claim 11, wherein the claw members of the first arm are substantially longer than the first and second spike members, and the first and second spike members are of different length.

13. A device as claimed in claim 11, wherein the first claw members and the first and second spike members of the first arm, generally extend in a first direction or the same direction, and the second claw members, and the first and second spike members of the second arm, generally extend in a direction opposite to the first direction.

14. A device as claimed in claim 11, wherein:

the first claw members, and the first and second spike members, of the first arm, extend in different directions, the second claw members, and the first and second spike members, of the second arm, extend in different directions, and the first and second spike members of the first and second arms are oriented towards the first and second handle members.

15. A hair clip device comprising:

a first arm defining an inwardly facing surface and provided with a plurality of first claw members, a second arm defining an inwardly facing surface and provided with a plurality of first claw members, wherein at default the claw members of the first arm and the second arm are arranged alternately and complementarily, and a first handle member connected to the first arm, and a second handle member connected to the second arm, the first and second handle members pivotably connected together cooperatively configured for controlling relative movement of the first and second arms, first and second spikes members extending from the inwardly facing surface of the first arm, first and second spikes members extending from the inwardly facing surface of the second arm, wherein for improving tightness in hair securing by the hair clip:

the first spike members of the first arm become progressively shorter towards the rear end of the first arm, the second spike members of the first arm become progressively shorter towards a rear end of the first arm, the first spike members of the second arm are become progressively shorter towards a rear end of the second arm, the second spike members of the second arm become progressively shorter towards the rear end of the second arm, and the first handle is provided with further first claw members, and the second handle is provided with further second claw members.

16. A device as claimed in claim 15, wherein the claw members of the first arm are substantially longer than the first and second spike members, and the first and second spike members are of different length.

17. A device as claimed in claim 15, wherein:

the inwardly facing surface of the first arm is non-planar, distal ends of the first spike members of the first arm extending from the inwardly facing surface of the first arm define a plane where the first spike members thereof end, distal ends of the second spike members of the first arm extending from the inwardly facing surface of the first arm define a plane where the second spike members end, the inwardly facing surface of the second arm is non-planar, distal ends of the first spike members of the second arm extending from the inwardly facing surface of the second arm define a plane where the first spike members thereof end, and distal ends of the second spike members of the second arm extending from the inwardly facing surface of the second arm define a plane where the second spike members thereof end.

18. A device as claimed in claim 15, wherein, at default:

the first spike members of the first arm and the first spike members of the second arm do not overlap with each other, and the second spike members of the first arm and the second spike members of the second arm do not overlap with each other.

19. A device as claimed in claim 15, wherein the first spike members have a length less than half of the length of the first claw members.

* * * * *